United States Patent [19]

Moore

[11] Patent Number: 4,470,458

[45] Date of Patent: Sep. 11, 1984

[54] WELL TOOL

[75] Inventor: Roger G. Moore, Katy, Tex.

[73] Assignee: Cameron Iron Works, Inc., Houston, Tex.

[21] Appl. No.: 390,688

[22] Filed: Jun. 21, 1982

[51] Int. Cl.[3] ..... E21B 43/10

[52] U.S. Cl. ..... 166/212; 166/72; 166/322; 166/375; 294/86.34

[58] Field of Search ..... 166/72, 125, 131, 181, 166/184, 208, 212, 312, 320, 321, 322, 338, 339, 340, 348, 374, 375, 382, 383; 294/86.34, 86.12

[56] References Cited

U.S. PATENT DOCUMENTS

| | | | |
|---|---|---|---|
| 3,752,232 | 8/1973 | Bell et al. | 166/285 |
| 3,863,719 | 2/1975 | Parker | 166/131 |
| 3,885,625 | 5/1975 | Ahlstone | 166/181 |
| 3,924,678 | 12/1975 | Ahlstone | 166/208 |
| 3,944,273 | 3/1976 | Ahlstone | 294/86.34 |

*Primary Examiner*—William F. Pate, III
*Assistant Examiner*—Hoang C. Dang
*Attorney, Agent, or Firm*—Vinson & Elkins

[57] ABSTRACT

A well tool for running, cementing and washing a well housing or casing hanger including a tubular body, a cementing stinger on the lower end of the body, a well housing releasably supported on the body, a hollow skirt having inwardly facing ports and positioned in surrounding relationship to the upper end of the housing, a washing fluid supply to the skirt, a pressure responsive valve in the washing fluid supply, the support for the well housing including a pressure responsive release and the pressure responsive valve and the release are connected so that the supply of washing fluid under pressure to the connection opens the valve and actuates the release for the washing step and the step of retrieving the well tool.

11 Claims, 5 Drawing Figures

WELL TOOL

BACKGROUND

In drilling offshore oil and gas wells, it is common to run the downhole housing, such as casing, and cement through a string to place cement in the annulus surrounding such housing. Such housing is then usually washed to assure that any profile in the upper end of the housing is free of the cement.

It has been recognized that it is advantageous to run the housing, cement stinger and wash tool all on one string to avoid extra trips of the string to accomplish such steps. U.S. Pat. No. 3,885,625 is an example of such combination. Such patent discloses a combination tool in which a dart is used to close the bore of the tool and ports are uncovered by rotation of the string for washing cement from the upper portion of the casing hanger body. The washing liquid flows downward in an annulus surrounding the hanger body. The rotation also releases the tool from the hanger body.

While prior art tools have been able to run, cement and wash in a single trip they have not provided any means of directing jets of washing liquid against the exterior locking profile.

SUMMARY

The present invention relates to an improved well tool including a tubular running tool, means for latching the running tool to a downhole housing, a hollow annular skirt surrounding the tool, means communicating from the interior of the tool to the interior of the skirt, inwardly facing openings in the skirt, valve means in said communicating means, the skirt having means for releasably engaging said housing to prevent rotation when the running tool is rotated, and hydraulic lines connecting to said valve means and the latching means so that the tool is unlatched from the housing when washing liquid is delivered to the washing skirt.

An object of the present invention is to provide an improved well tool for running, cementing and washing a housing into a well bore.

A further object is to provide an improved running, cementing and washing tool which has improved washing of the upper exterior profile of the cemented housing.

Another object is to provide an improved running, cementing and washing tool having alternate means for releasing the tool from the cemented housing.

Still another object is to provide an improved running, cementing and washing tool with hydraulic controls and control lines which are not affected by rotation of the running string.

BRIEF DESCRIPTION OF THE DRAWINGS

These and other objects, features and advantages are hereinafter set forth and explained with respect to the drawings wherein.

DESCRIPTION OF THE PREFERRED EMBODIMENT

Figure 1:
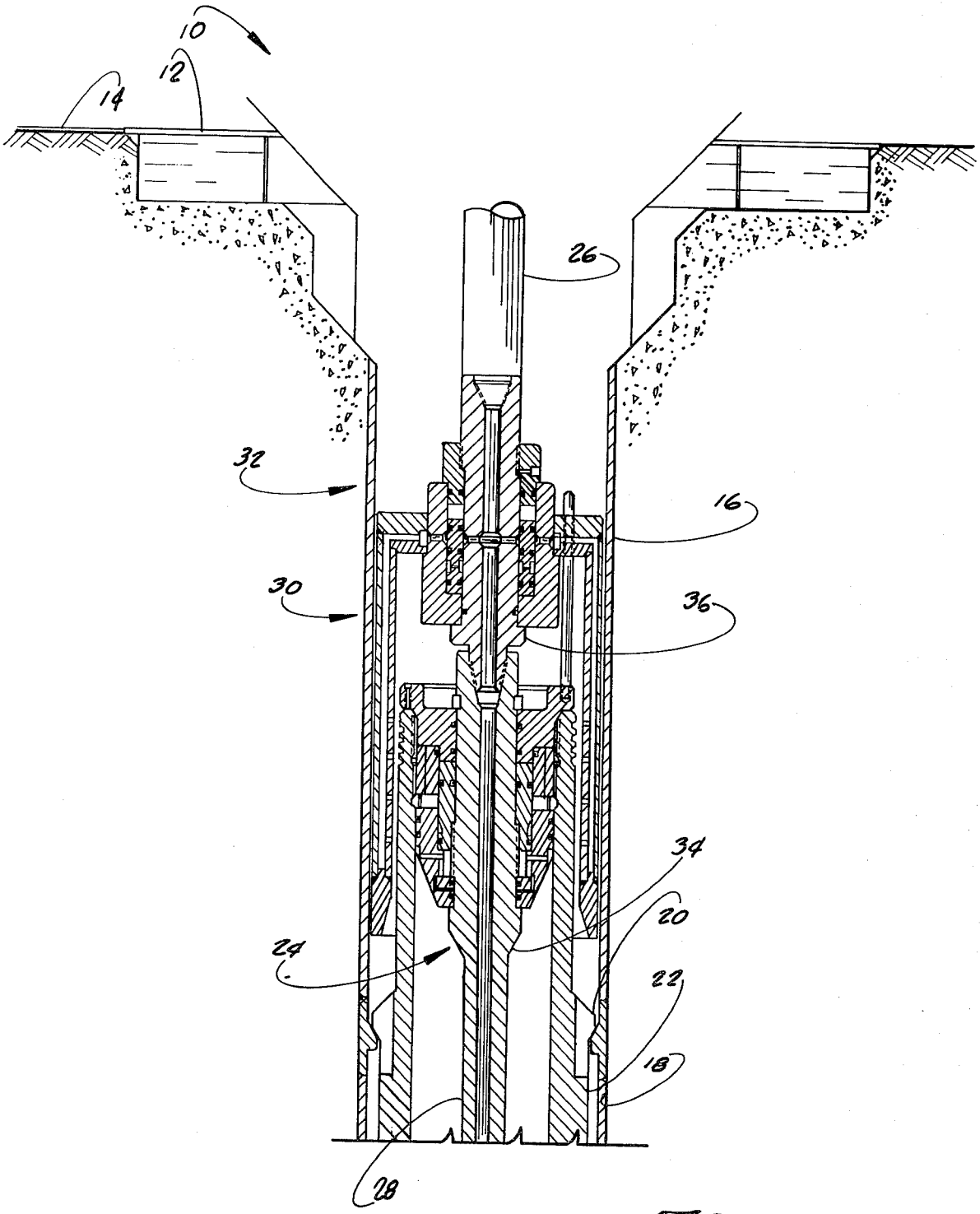
FIG. 1 is a sectional view of a subsea wellhead and well bore with the improved well tool of the present invention having run a well housing.

Subsea wellhead 10 is shown in FIG. 1 with base 12 resting on bottom 14 and connected to large diameter conductor 16 which extends downward in well bore 18. Seat 20 is on the interior of conductor 16 to receive and support well housing or casing hanger 22 thereon. In the drawings the upper portion of the wellhead 10 is omitted since hanger 22 may be supported on seat 20 near wellhead 10 or on suitable seat which is much lower in well bore 18.

Well tool 24 is connected and lowered on running string 26 and includes cementing stinger 28 (the lower portion of which is not shown but is of any usual design), latching means 30 for releasable supporting casing hanger 22 and washing means 32 for washing cement from the upper portion of casing hanger 22. Well tool 24 includes lower tubular body 34 with cementing stinger 28 being integral therewith and upper tubular body 36 connected to lower body 34 and having means to connect to running string 26.

Supporting means 30 includes lower body 34 having upwardly facing shoulder 38, housing 40 surrounds body 34 and is supported on shoulder 38, annular closure 42 surrounds body 34 and is held thereon by split ring 44, and annular piston 46 around body 34 and within housing 40. Piston 46 is slidable within chamber 48. Windows 50 extend through housing 40 and pins 51 and locking ring 52 are positioned in windows and are movable inwardly and outwardly responsive to the movement of piston 46 which has a tapered outer surface 54 so that when piston 46 is moved downward pins 51 and locking ring 52 are forced outward of housing 40 to engage in groove 56 on the interior of casing hanger 22. In this position casing hanger is supported on running string 26. Release or unlatching is accomplished by supplying hydraulic fluid to the lower end of chamber 48 through line 58 (FIG. 4) to move piston 46 upward. Piston 46 is moved downward responsive to hydraulic fluid supplied through line 60 to the upper end of chamber 48. Thus a pressure responsive latching and unlatching means provides the engagement of the support means 30 to casing hanger 22.

Figure 4:
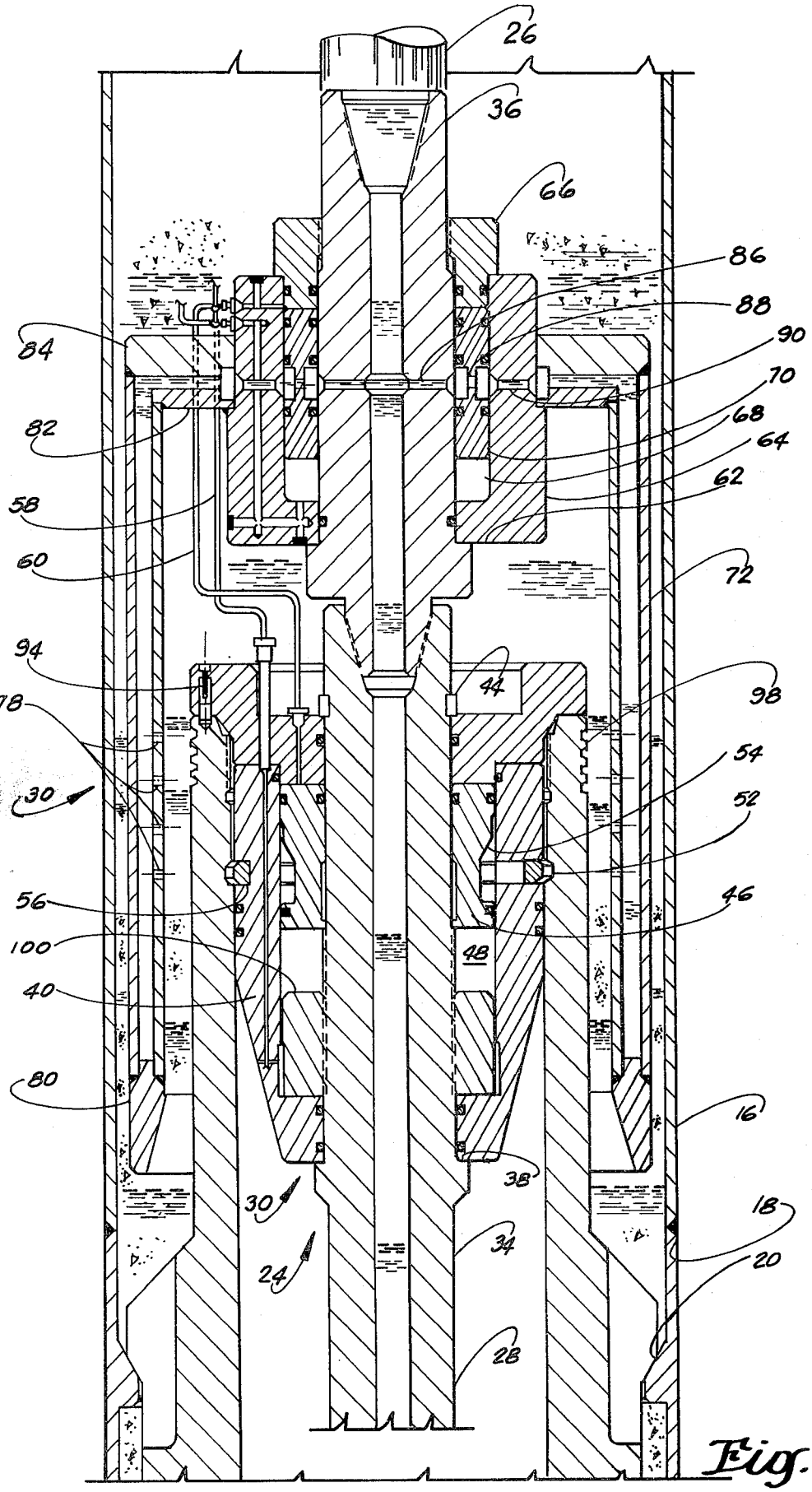
FIG. 4 is a sectional view showing the washing of the upper exterior of the cemented housing.
Figure 5:
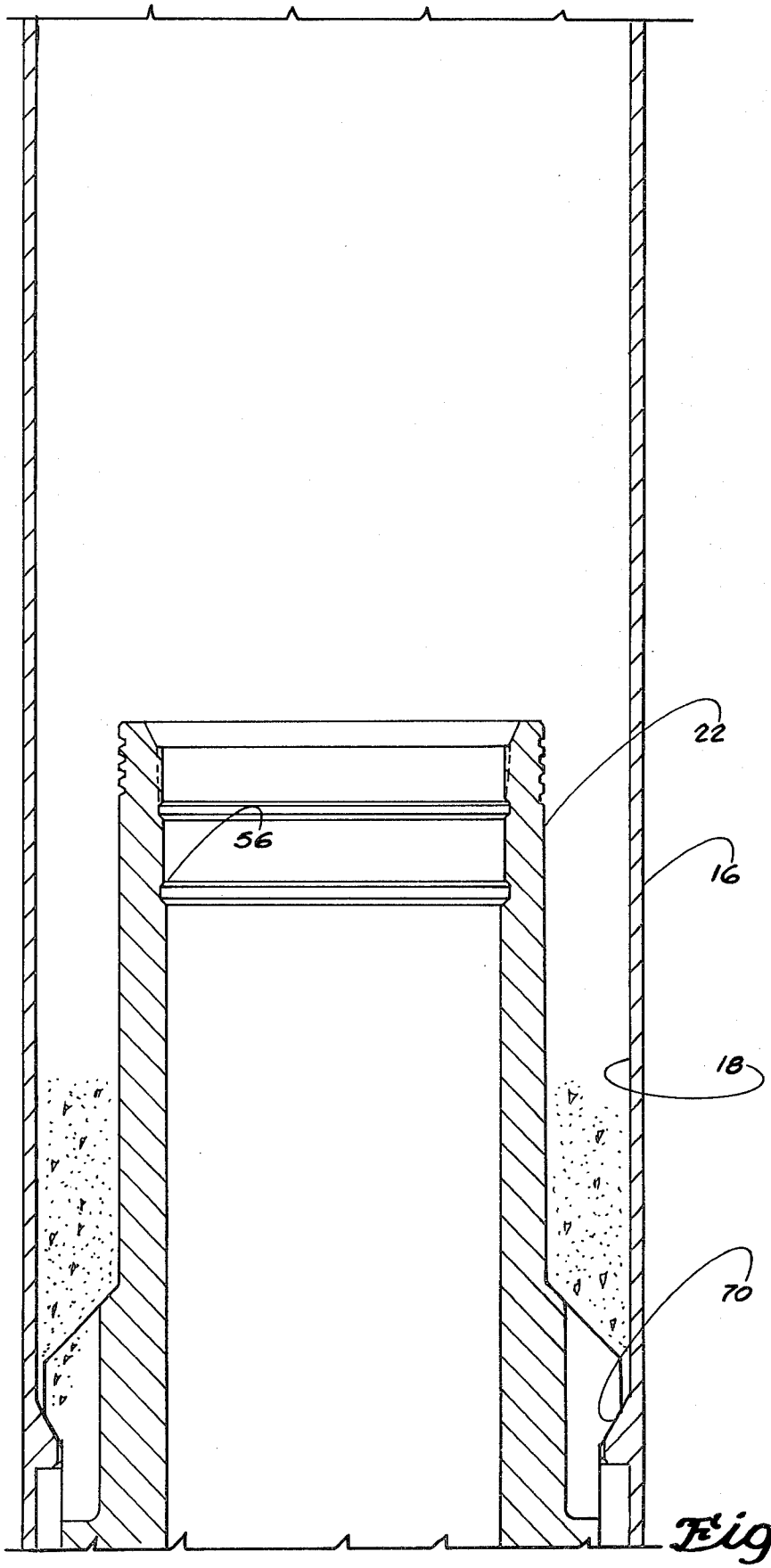
FIG. 5 is a sectional of the cemented housing after the retrieval of the well tool.

Washing means 32 includes upper tubular body 36 having upwardly facing shoulder 62, housing 64 surrounding body 36 and coacting with ring 66 threaded on body 36 to form chamber 68 in which piston valve 70 is slidably positioned and hollow skirt 72 which is secured to housing 64 as hereinafter described. Skirt 72 includes outer shell 74 inner shell 76 having ports 78 therein, lower closure ring 80 secured between the lower ends of shells 74 and 76. Ring 82 is secured to the upper end of shell 76 and to housing 64 and ring 84 is secured to the upper end of shell 74 and to housing 64 and is spaced above ring 82. Ports 86 extend through upper body 36 into chamber 68. Piston valve 70 includes ports 88 extending therethrough and suitable seals so that in its upper position (FIG. 4) washing fluid can flow through ports 86, ports 88 and ports 90 through housing 64 into skirt 72. Pins 92 extend from closure 42 to rings 82 and 84 to ensure that skirt 72 does not rotate with respect to closure 42. Pin 94 extends from the lower outer portion of closure 42 and is engaged in recess 96 in the upper end of casing hanger 22. Piston valve 70 is moved upward to its open position as shown in FIG. 4 by supplying hydraulic fluid to line 58 which communicates to the lower end of chamber 68. Supplying hydraulic fluid to line 60 exerts a pressure in the upper end of chamber 68 to move piston valve 70 downward to its closed position. Thus a pressure responsive valve means is provided to control the flow of washing fluid to skirt 72.

Figure 2:
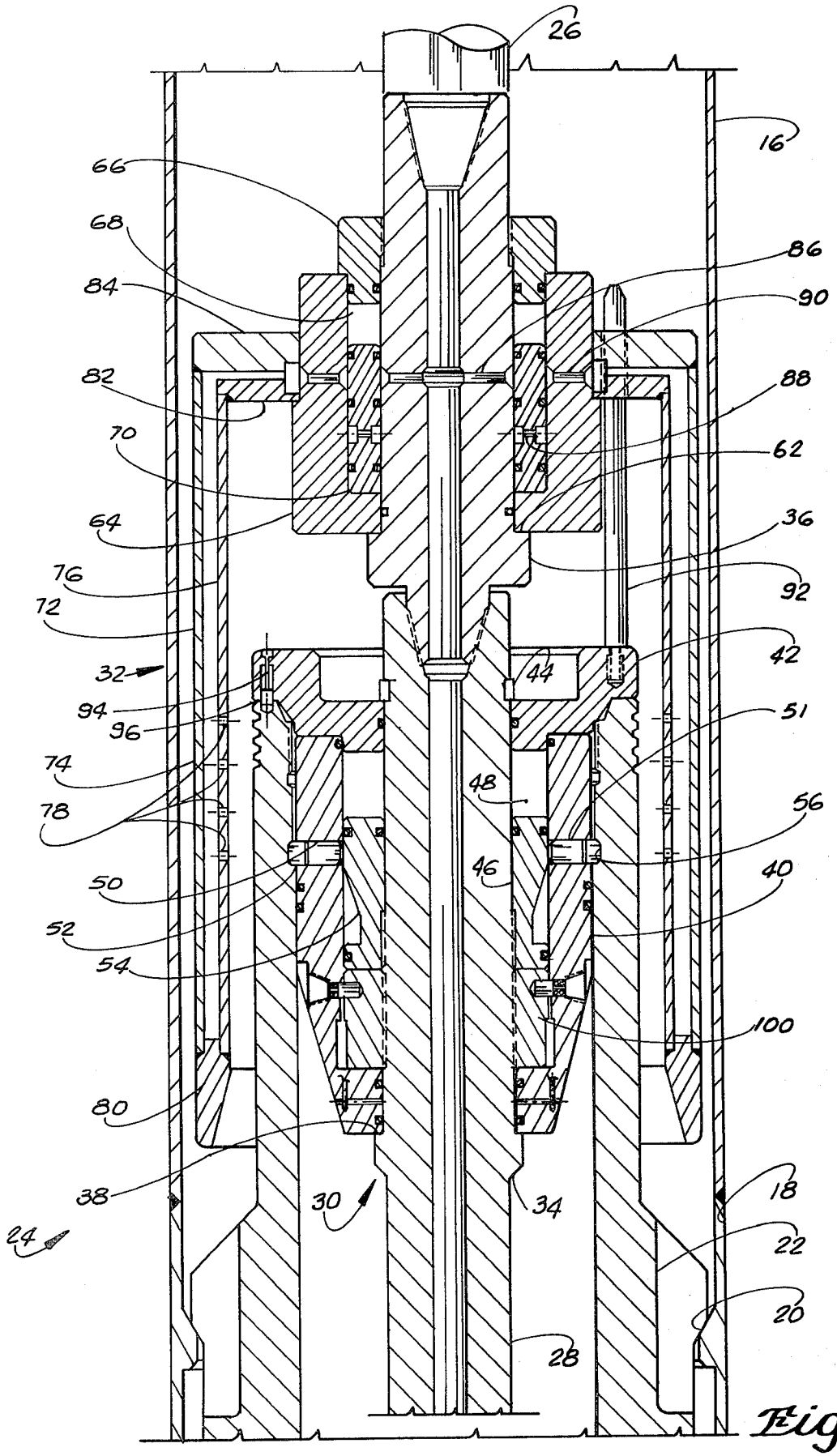
FIG. 2 is an enlarged sectional view of the improved tool with the well housing in seated position.
Figure 3:
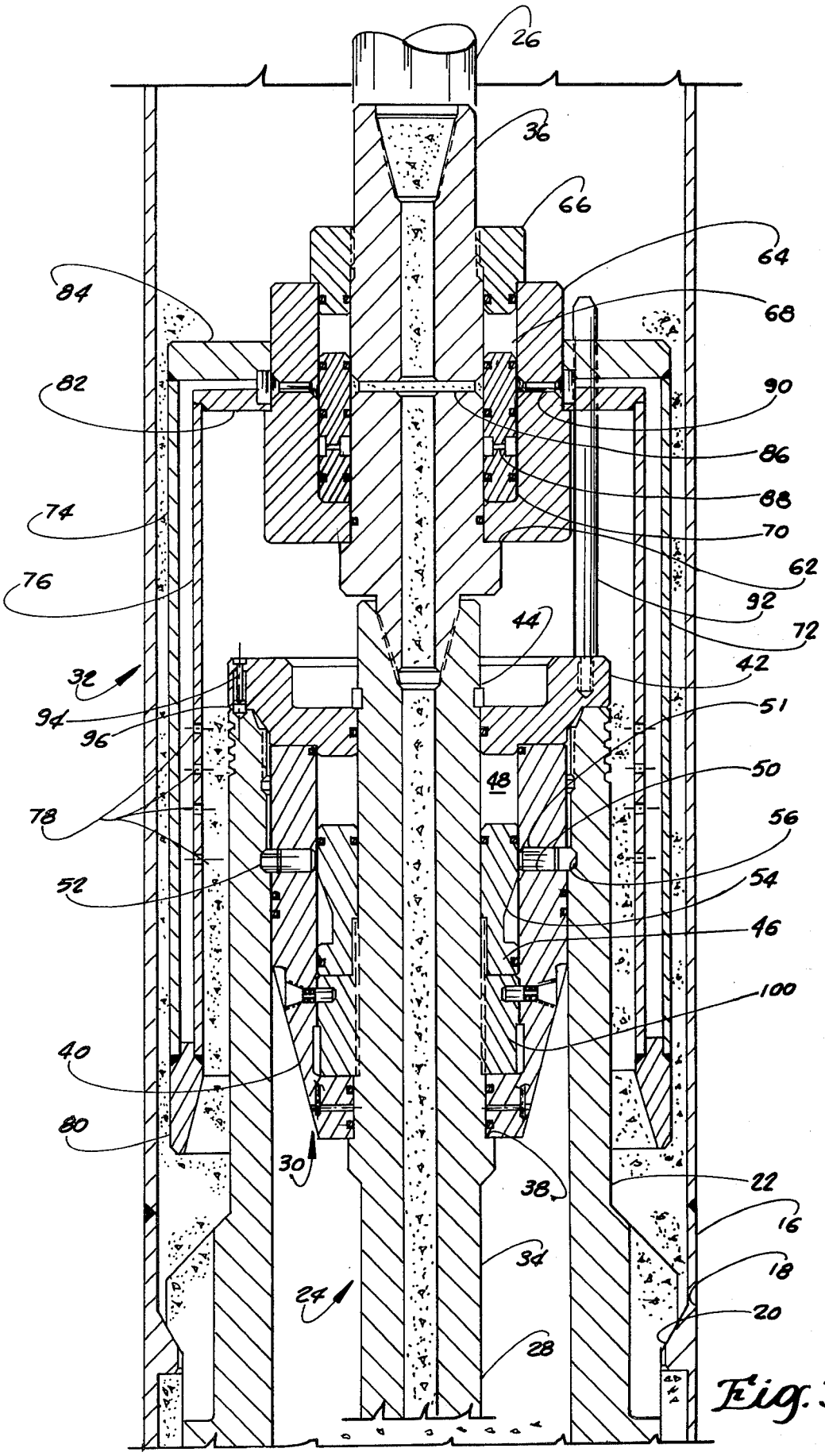
FIG. 3 is a sectional view illustrating the cementing of the housing.

In operation, well tool 24 is made up and connected to casing hanger 22 and to running string 26 and is lowered through the riser (not shown) into well bore 18 until casing hanger 22 is seated on seat 20, as shown in FIGS. 1 and 2. During make-up, support means 30 is actuated to latch to hanger 22 by supplying hydraulic fluid through line 58 to move piston downward. Also this causes piston valve 70 to move to its closed position.

Cementing through running string 26, well tool 24 and stinger 28 is started when hanger 22 is landed on seat 20. On completion of the pumping of cement, a suitable plug or ball is inserted in string 26 following cement to seat in the end of stinger 28 when the cement is in place.

With cementing complete hydraulic fluid is supplied through line 58 which moves a piston 46 to its unlatched position and moves a piston valve 70 to its open position to allow flow of washing fluid through ports 86, valve ports 88, ports 90, the space between rings 82 and 84, the annular space between shells 74 and 76 and is discharged through ports 78 toward the upper exterior of hanger 22 to clear cement particularly from its external profile 98. Slight lifting of string 26 allows skirt 72 to be rotated around hanger 22 as soon as pin 94 disengages from recess 96.

An alternate release is provided by rotating running string 26 which rotates body 34 and 36. This allows manual unlock ring 100 which is threaded onto body 34 to travel up and pushes piston 46 within chamber 48 allowing pin 51 and locking ring 52 to retract from locking groove 56.

What is claimed is:

1. A well tool comprising a tubular body having an upper end and a lower end with a cementing stinger on its lower end and means for connecting to a running string at its upper end, remotely operated latching means on said body for engaging a housing, a washing skirt rotationally mounted on said body above said latching means, said skirt having a diameter and height sufficient to extend downward around the exterior of the upper end of the well housing housing supported by said latching means on said tubular body, said skirt having inwardly facing ports, means providing fluid communication from the interior of said body to said skirt ports, and remotely controlled valve means in said fluid communication means.

2. A well tool according to claim 1 including means connecting to said valve means and said latching means to open washing fluid flow and unlatch said latching means responsive to pressure fluid supplied to said connecting means.

3. A well tool according to claim 1 including means connected to said skirt to prevent relative rotation of said skirt with respect to said latching means.

4. A well tool according to claim 3 wherein said rotation prevention means is disengaged by lifting said skirt from said latching means.

5. A well tool according to claim 1 wherein said valve means is a pressure responsive piston valve.

6. A well tool according to claim 1 wherein said latching means includes a pressure responsive means for latching and unlatching said body to and from the housing.

7. A well tool according to claim 1 wherein said tubular body includes an upper tubular body with said washing skirt and said valve means mounted thereon, and a lower tubular body threadedly connected to said upper tubular body with said latching means mounted on said lower tubular body.

8. A well tool according to claim 1 wherein said latching means includes a plurality as radially movable latching elements, a piston having a cam surface which engages said latching elements and in one position cams said elements into latching engagement with the housing to be supported thereon.

9. A well tool according to claim 8 including the housing having an internal groove in its upper portion sized to receive said latching elements so that said housing is supported on said tubular body.

10. A well tool comprising a tubular body having a cementing stinger on its lower end and means for connecting to a running string on its upper end, a pressure responsive housing support means mounted on said body, pressure responsive washing means mounted on said body and having ports directed radially inward, and means for supplying pressure fluid to said support means and to said washing means, means for interconnecting said supply means, said washing means and said support means so that fluid pressure to said supply means releases said support means and opens said washing means.

11. A well tool comprising a first tubular mandrel having a cementing stinger extending therefrom and an upwardly facing external shoulder, an annular latching housing engaging said mandrel shoulder and having a plurality of windows, a well housing having an exterior profile on its upper end, a plurality of latching elements with one of said elements in each of said windows, a closure surrounding said mandrel and engaging the upper end of said latching housing and having means for preventing relative rotation of said closure and said well housing, pressure responsive means for moving said latching elements outward into latching engagement with a groove on the interior of said well housing, means retaining said closure on said first mandrel, a second tubular mandrel connected to said first mandrel and having an upwardly facing external shoulder, a wash housing surrounding said second mandrel and engaging said second mandrel external shoulder, a hollow skirt supported on said wash housing and having inwardly facing ports, said skirt having a larger inner diameter than the upper outer diameter of the housing and depending a substantial distance below said closure to allow direct washing of the exterior profile of said well housing, means communicating from the interior of said second mandrel to the interior of said skirt, valve means in said communicating means, pressure responsive means in said communicating means, and means interconnecting said pressure responsive latch moving means and said valve means whereby said latching elements are released when said valve means are open for washing.

* * * * *